US007531032B2

(12) United States Patent
Cordova

(10) Patent No.: US 7,531,032 B2
(45) Date of Patent: May 12, 2009

(54) ACRYLIC BASED PAINT FOR POLYMERIC SURFACES

(75) Inventor: Abimael Cordova, Whittier, CA (US)

(73) Assignee: Mattel, Inc., El Segundo, CA (US)

( * ) Notice: Subject to any disclaimer, the term of this patent is extended or adjusted under 35 U.S.C. 154(b) by 627 days.

(21) Appl. No.: 11/215,498

(22) Filed: Aug. 30, 2005

(65) Prior Publication Data

US 2007/0049663 A1 Mar. 1, 2007

(51) Int. Cl.

| | |
|---|---|
| ***C08L 1/28*** | (2006.01) |
| ***C08L 5/04*** | (2006.01) |
| ***C08L 5/12*** | (2006.01) |
| ***C08L 29/04*** | (2006.01) |
| ***C08L 39/06*** | (2006.01) |
| ***C08K 5/42*** | (2006.01) |
| ***C08K 5/103*** | (2006.01) |
| ***C08K 5/53*** | (2006.01) |
| ***C08K 5/09*** | (2006.01) |
| ***C08K 3/34*** | (2006.01) |
| ***C08K 3/22*** | (2006.01) |

(52) U.S. Cl. ..... 106/31.25; 106/31.33; 106/31.65; 106/499; 525/57; 525/229

(58) Field of Classification Search ..... 106/31.25, 106/31.33, 31.65, 499; 525/57, 229
See application file for complete search history.

(56) References Cited

U.S. PATENT DOCUMENTS

| | | | | |
|---|---|---|---|---|
| 3,947,398 | A * | 3/1976 | Williams | 524/5 |
| 5,276,075 | A | 1/1994 | Santini | 524/40 |
| 5,288,160 | A | 2/1994 | Li et al. | 401/98 |
| 6,316,544 | B1 | 11/2001 | Sarkar | 524/832 |
| 6,656,998 | B1 * | 12/2003 | Robeson et al. | 524/501 |
| 2003/0219569 | A1 * | 11/2003 | Aono | 428/141 |

* cited by examiner

*Primary Examiner*—Kelechi C Egwim
(74) *Attorney, Agent, or Firm*—Robert W. Mulcahy

(57) ABSTRACT

The invention is directed to an aqueous based resin coating and paint composition comprising as essential ingredients, a colorant, a polyvinyl acetate polymer/acrylic polymer emulsion blend primary binder, a polyvinyl-based film forming resin secondary binder, such as polyvinyl alcohol, and water with sufficient amount of a surface active agent to form a stable suspension. The coating or paint composition is applied onto an elastomeric or polyvinyl chloride surface until the coating can be thermally treated or evaporated to incorporate the coating into the elastomeric or polyvinyl chloride surface as a permanent color. The invention also comprises a method for the preparation of the aqueous-base coating composition in which the essential components are prepared as aqueous dispersions or emulsions which are blended together to form the final coating or paint composition.

6 Claims, No Drawings

ACRYLIC BASED PAINT FOR POLYMERIC SURFACES

BACKGROUND OF THE INVENTION

1. Field of the Invention

The present invention relates to a novel and improved coating composition and process for applying a water-based vinyl acetate/acrylic polymer blend emulsion copolymer based coating or paint to polyvinyl chloride or styrenic elastomeric polymer surfaces, particularly to toy articles. Because the coating composition uses water based solvents, it can be applied as a coating or paint for toy articles which can be safely used by children.

2. Description of the Related Art

Generally, the technology surrounding the manufacture of toys centers on creation of a toy item such as doll, miniaturized application of conventional clothes, manufacture of a doll body using plush or other sculptural techniques, and the simulation of the hair with sculptural elements, fibers, or other techniques. In addition to dolls, hand painted clothing and fabrics have become increasingly popular among child and adult consumers over the past several years. This popularity has spurred the development of craft kits that are designed to allow the consumer to make his or her own hand painted clothing or fabrics. In the case of dolls, soft elastomeric rubber materials such as styrene-butadiene rubber (SBR) and styrene-butadiene-styrene (SBS) block copolymer (Kraton) elastomers are used extensively in the production of doll heads because of their realistic look and feel. Polyvinyl Chloride has been one of the polymeric materials of choice for miniaturized fabrics because of its availability, relative inexpensiveness, flexibility, and strength as paint receptive sheet materials for clothing and the like. However, it has proven difficult to provide a paint composition that, when applied to fabrics and elastomeric sufaces in toy articles, possesses desirable aesthetic and wear properties while also being capable of withstanding repeated physical abuse endemic to toys without losing these properties.

One of the desirable aesthetic properties sought after by toy consumers in such paints is a high degree of gloss. In addition, the paint should have sufficient flexibility so that cracking does not occur as the toy article or fabric moves during cleaning or wear; that is the painted surface should be washable. Paints which allow the creation of three-dimensional lines on a fabric or a flexible skin surface of an article, and which will hold this configuration after drying, are also highly desirable. Another desirable property is the ability of a paint to provide a "glitter" effect when exposed to light. Further, it is advantageous that any such paint be relatively non-toxic and economical to produce.

Regardless of the type of paint used on a toy doll article, it has remained imperative that such materials be safe for young children. Safety requirements have evolved through the years as safety concerns have grown. Generally, safety mandates that any material compositions used in a toy be odorless, nonirritating to the skin or eyes or the like, and be nontoxic if ingested. Additional requirements have been expected of materials used to coat or paint toy articles in that they must be non-peeling, requiring that the coating or paint tenaciously adhere to the toy item to avoid flaking or peeling and possible consumption by a child user. Accordingly, such paints should be resistant to oxidation and flaking, particularly as applied to elastomeric rubber surfaces of soft doll faces. And further the paint should be able to withstand the stretching and other physical abuse of a child so that the appearance of the painted surface is maintained. And above all the paint or coating composition must avoid the use of undesirable volatile organic solvents the residual presence of which can be dangerous due to the toxic effect of certain aromatic and chlorinated hydrocarbon solvents. In view of the environmental, health and safety concerns in the use of highly toxic organic solvents, less controversial solvents such as water are used to provide toy paint or coating compositions, as in the case of the instant invention.

As indicated above, the class of the styrenic elastomeric materials commonly used to mold doll faces and other toy articles are A-B-A type block polymers such as styrene-butadiene-butylene-styrene or styrene-butadiene-styrene, manufactured by Shell and sold under the trademark Kraton. The molded elastomeric doll faces tend to be dull and unattractive and so are finished by application of a skin coating or paint to provide a good facial appearance to this facial piece. Fabric items made from polyvinyl chloride also require a paint which will be capable of maintaining a high degree of gloss during use, can hold a dimensional line after drying, and/or can be brushed out flat. It has now been found that a coating composition comprising a certain water-based vinyl acetate emulsion copolymer/acrylic polymer latex blend and polyvinyl alchol has particular advantages in forming tenaciously bonded adhesive coatings on styrenic resin and polyvinyl chloride.

Vinyl acetate homopolymer and copolymer emulsions are well known in latex paint formulations. It has further been found that vinyl acetate-ethylene emulsions can be blended with acrylic polymers to achieve superior exterior paint formulations. In fact, data exists to prove that a blend ratio of up to 49% vinyl acetate-ethylene emulsions with as much as 51% acrylic polymers produces coatings with properties essentially comparable to those of coating based on 100% acrylics. The instant compositional invention exploits this finding to achieve a new coating formulations which are particularly effective on polyvinyl and elastomeric sufaces of toy articles.

The present application provides an aqueous-base coating composition containing a vinyl acetate homopolymer or copolymer emulsion/acrylic polymer latex blend binder and a polyvinyl resin (eg. polyvinyl alcohol) film forming binder composition which is effective in retaining an applied film of the coating composition after its application to the surface of an elastomeric or polyvinyl chloride object and prior to the thermal or cure bonding of the composition to the object's surface.

SUMMARY OF THE INVENTION

In accordance with the present invention, there is provided an aqueous-base coating or paint composition containing, as essential components, finely-divided, water-dispersable ingredients of a (a) colorant, (b) a vinyl acetate polymer emulsion/acrylic polymer latex blend primary binder (c) a particulate polyvinyl resin (eg. polyvinyl alcohol) based secondary binder composition, and (d) water with sufficient amounts of a surface active agent to form a stable suspension. The coating composition is applied as a film or water borne glossy paint coating onto a styrenic elastomeric or polyvinyl chloride surface and the binder temporarily binds the coating to the surface until the coating can be thermally treated to incorporate the coating into the surface material, permanently coloring that surface. A primary binder blend ration of up to 49 wt % vinyl acetate polymer and up to 51% acrylic polymer produces coating with optimum gloss and adhesion characteristics. The invention also comprises a method for the preparation of the aqueous-base coating composition in which the essential components are prepared as aqueous dispersions or emulsions which are blended together to form the final coating composition.

The coating composition medium of the current invention is preferably a water-based medium with a polyvinyl acetate polymer/acrylic polymer blend emulsion body that provides the medium with the desired viscosity and rheology. To the medium a hydroscopic polyvinyl resin in the form of polyvinyl alcohol is added as a secondary binder which acts as a film forming agent that facilitates the surface adhesion of the instant latex coating composition upon curing and/or heating.

In one mode, the coating composition of the current invention is made by mixing an acrylic polymer latex with the water-based polyvinyl acetate emulsion copolymer and then mixing in a polyvinyl alcohol based hydroscopic polymer. An acrylic thickener or a cellulosic thickener can be then added to the mixture of the acrylic polymer emulsion and the water-based vinyl acetate copolymer binder emulsion composition and the pH of the total mixture is adjusted to provide the desired viscosity and rheology for the coating medium. The medium also preferably includes a preservative to prevent fungal or bacterial growth during storage of the coating composition. Optionally, the aqueous solution of polyvinyl alcohol may be prepared first and the pre-prepared polyvinyl acetate polymer/acrylic polymer latex emulsion added thereafter with mixing.

The vinyl acetate copolymers of the primary binder herein preferably contains up to 15 weight percent of comonomer such as ethylene, other vinyl esters and acrylates. This vinyl acetate polymer must have a dry glass transition temperature (Tg) above room temperature (23° C.) but a wet Tg below room temperature and must also be film forming at room temperature. These vinyl acetate polymers are unique in this respect and differ functionally as well as chemically from the high Tg ("hard") polymers used in the prior art to enhance blocking resistance in glossy paints containing soft polymers.

The vinyl acetate polymer of the primary binder herein can be a copolymer of vinyl acetate and ethylene or a copolymer of vinyl acetate and an alkyl acrylate, the alkyl group preferably containing 1 to 8 carbons. The vinyl acetate polymer herein can also be a terpolymer of vinyl acetate-vinylchloride-ethylene. The vinyl acetate polymer used herein is also film forming at room temperature, having a Tg less than 20° C. The acrylic polymers in the primary binder blend are polymers of acrylic or methacrylic acid, a preferred acrylic being cross-linked polyacrylic acid polymers and modified forms thereof. When the vinyl acetate copolymer emulsions are blended with acrylic polymers at the ratios described above, an exceptional premium binder for a coating or paint is achieved having the above-mentioned characteristics: good wet adhesion to elastomeric and polyvinyl chloride substrates, as well as improved resistance to paint cracking.

Consequently the resulting applied coatings herein are characterized by an exceptional durability, elongation and flexibility. Because the instant coating compositions are aqueous and optionally employ certain other high evaporation rate organic solvents, they are safe for use as paints for children's toys and are particularly useful in applications to the soft elastomeric materials used in doll facial structures and polyvinyl chloride surfaces where the paint coatings are expected to withstand the rigorous and hostile environment of child use.

DETAILED DESCRIPTION OF THE INVENTION

The invention comprises an aqueous-base coating composition which contains a finely-divided dispersion of (i) a colorant, (ii) a water-dispersable vinyl acetate based resin primary binder comprised of a water-based vinyl acetate copolymer/acrylic polymer latex-emulsion mixture, (iii) a film forming polyvinyl based resin secondary binder and (iv) water with sufficient amount of a surface active agent to form a stable suspension and a method for its preparation.

The preferred polyvinyl resin secondary binder is polyvinyl alcohol. This preferred polyvinyl alcohol component of the coating composition has a finely subdivided or powdered state with a particle size from less than 1 micron to about 140 microns, preferably from 5 to about 40 microns, maximum particle diameter. The density of the polyethylene powder ranges from about 0.88 to 0.97 grams per cubic centimeter. The polyvinyl alcohol is used in an amount from 20 to about 80, preferable from 25 to 50, weight percent of the total solids content of the coating composition.

Various pigments can be used as the colorant component in the instant paint and coating composition. Pigments which are useful include those containing inorganic pigments such as titanium dioxides (rutile, anatase), zinc oxide, iron oxides in hues such as yellow, buff, tan, brown, salmon and black, iron chromates and molybdates for colors from light yellow to red orange, lead chromates, lead sulfate, lead molybdate, chrome yellows and oranges, cadmium pigments in a variety of yellows, oranges, reds and maroons as pure cadmium colors or with barium sulfide (lithopones), cadmium mercury mixtures, cadmium sulfide or cadmium sulfoselenides, nickel and titanium dioxide mixtures, sodium, potassium or ammonium coordination compounds of ferri-ferrocyanide, ultramarine blues (a calcined mixture of china clay, sodium carbonate, silica, sulfur and reducing agents), cobalt aluminate (cobalt blues), chromium oxide, metal flake pigments such as aluminum, zinc, copper, bronze powders, metal silver pigments, pearlescent and iridescent flakes of basic lead carbonates, bismuth oxychlorides and titanium coated mica, etc. Various organic pigments which are useful include azo pigments, such as benzimidazolone pigments, pyrazolone pigments, copper phthalocyanine, quinacridones, anthraquinones, condensation pigments, tetra-chloro-isoindolinones, carbon blacks, etc. The solid colorants should be of the same size range as specified for the secondary polyvinyl resin (eg. polyvinyl alcohol) component and should be prepared as a water dispersion with sufficient of a surface active agent to form as stable suspension.

The amount of suitable pigments included is determined by the ability to maintain a stable paint composition without the need for excessive mechanical agitation. Examples of such suitable pigments include organic pigments such as carbon black, phthalocyanines (e.g., copper phthalocyanine blue), azo pigments, quinacridones, anthraquinones, dioxazines, indios, thioindios, perynones, perylenes, indolenones and azo-azomethines. Fluorescent pigments and encapsulated pigments may also be utilized. Other pigments including, for example, inorganic pigments in ultrafine encapsulated or modified form, are likewise suitable for use. The pigment colorant is used at a concentration from 1 to about 60, preferable from 1 to 40, weight percent of the solids content of the coating composition. The effective amount depends on the type and identity of the selected colorant.

To achieve good coloring and promote compatibility with the remaining components, the pigment may also be utilized in the form of an aqueous dispersion, inasmuch as pigments are by definition insoluble materials. Pigment dispersions are commercially available which are combinations of a pigment, an aqueous based carrier, one or more resins, and a surfactant or dispersant system. A pigment dispersion may also be prepared specifically for use in the coloring compositions of the invention. From the standpoint of convenience, a commercial pigment dispersion is preferred for use in the present invention. Typical commercial dispersions contain 30 to 74% by weight active pigment ingredients. Examples of suitable pigment dispersions include Hostafine Rubine F6B (C.I. Pigment Red 184 dispersion), Blue B2G (Pigment Blue 15-3), Black T (Pigment Black 7), and Yellow GR (C.I. Pigment Yellow 13) marketed by Clariant Corporation under the tradename "Hostafine Dispersions." The typical concentration of the paint and coating composition of the present invention containing a pigment colorant is from about 0.1% to about 10% by weight of the coloring composition.

The primary resin binder component functions to retain the film coating on the polyvinyl chloride or elastomeric surface after application of the coating composition and to modify the gloss, flexibility and hardness of the final coating. Useful primary binders herein are aqueous emulsions, dispersions or emulsifiable solids of polyacrylic acid and polyacrylates, polyurethanes, poly(vinyl-acetate) and copolymers and mixtures thereof. Particularly useful is a polyacrylic and poly (vinyl-acetate) emulsion. The vinyl acetate copolymer emulsion/acrylic polymer binder composition used herein is used at a concentration from 10 to about 75, preferably from 25 to about 60, weight percent of the solids in the coating composition. The effective concentration will vary depending on the selection of the binder; the preferred poly(vinyl-acetate)-acrylic emulsion is very effective at a concentration from 25 to 60 weight percent of the solids in the coating composition.

The vinyl acetate polymer used in the primary binder component of this invention can be a homopolymer, i.e. poly (vinyl acetate), or a copolymer containing at least 85 weight percent vinyl acetate such that the dry Tg is above room temperature and the wet (water immersion) Tg is below room temperature. Comonomers which can comprise up to 15 weight percent of this vinyl acetate polymer include other vinyl esters such as vinyl propionate, vinyl versatate and the like, methacrylates such as methyl methacrylate, ethyl methacrylate, n-butyl methacrylate and the like, acrylates such as methyl acrylate, ethyl acrylate, n-butyl acrylate and the like, acrylic acid, methacrylic acid, maleic anhydride (also maleic acid), vinyl ethylene carbonate, and vinyl chloride. Ethylene is the preferred comonomer for the vinyl acetate primary binder component herein.

The lower Tg copolymers of vinyl acetate are preferably copolymers of vinyl acetate and ethylene and copolymers of vinyl acetate and acrylic comonomers with the vinyl acetate making up at least 60 weight percent of the copolymer. The minimum amount of comonomer is that required to achieve the desired dry Tg for the copolymer. The acrylic monomer for the vinyl acetate can be an alkyl acrylate, preferably with the alkyl group containing 1 to 8 carbons, such as n-butyl acrylate, methyl acrylate, ethyl acrylate, 2-ethyl hexyl acrylate, and the like. Also included as possible copolymers of vinyl acetate are copolymers containing a third monomer, such as a terpolymer of vinyl acetate, ethylene and acrylates, such as n-butyl acrylate, ethyl acrylate, and the like. The copolymer of vinyl acetate and ethylene can also contain vinyl chloride as a third monomer. The vinyl acetate copolymers as described above can also contain small amounts of other monomers such as acrylic acid, methacrylic acid, maleic anhydride, and the like.

The vinyl acetate polymers of this invention can be produced by emulsion polymerization and the technology for polymerization is well known, having been commercially practiced for over four decades. These emulsions are prepared by the addition of vinyl acetate (and other monomers) to water containing a surfactant and/or protective colloid system. These surfactants can include anionic, non-ionic, and cationic surfactants. Generally anionic and non-ionic surfactants are preferred with non-ionic most preferred for this invention. The non-ionic surfactants include ethoxylated alkyl phenols and ethylene oxide/propylene oxide block copolymers. Protective colloids can also be employed as is or in admixtures with other surfactants. The preferred protective colloids of the instant composition are the film forming poly (vinyl alcohol), polyvinyl pyrrolidone (PVP) of the instant composition and, in some other applications, hydroxyethylcellulose (HEC). The polymerization of the vinyl acetate homopolymers and copolymers of this invention involves free radical initiated polymerization. Typical free radical initiators include organic peroxides, azo initiators (such as 2,2'-azobisisobutyronitrile), peroxysulfates and redox initiation systems. Redox initiation systems include persulfate-bisulfate, hydrogen peroxide-iron, hydroperoxide-iron, and chlorate-bisulfate systems. Specific systems include a combination of potassium methyl acrylate, sodium or ammonium persulfate with various reducing agents such as sodium hydrogen sulfite, ascorbic acid, erythrobic acid, sodium formaldehyde sulfoxylate, and the like. Chain transfer agents such as mercaptans and thiols can be added to control the molecular weight. Additional details of these emulsion polymers and their preparation are detailed in discussions by Daniels in Encyclopedia of Polymer Science and Engineering, Volume 17, "Vinyl Ester Polymers", pp. 393-425, Wiley-Interscience, New York, 1989, and by Vaandezande et al. in Emulsion Polymerization and Emulsion Polymers, edited by P. A. Lovell and M. S. El-Aasser, "Vinyl Acetate Polymerization", pp. 563-584, John Wiley & Sons, New York, 1997.

Within the purview of the present invention, suitable acrylic binders include Vinyl Acrylic emulsions and Vinyl Acetate polymer emulsions that preferably make up 50 to 95% of the total weight of the coating or paint medium. Good results have been obtained with AIRFLEX® 809, AIRFLEX® 728 and FLEXBOND® 381 polymer emulsions manufactured by Air products and Chemical, Inc.; Air Products Polymers, L. P., 7201 Hamilton Blvd., Allentown, Pa. 18195. AIRFLEX® 809 Polymer Emulsion is a Vinyl Acetate-Ethylene Polymer with particle sizes in the range of 0.15 to 0.30 microns and is sold as an emulsion solution in 40 to 60% water by weight. AIRFLEX® 728 Polymer Emulsion is a Vinyl Acetate-Vinyl Chloride-Ethylene Terpolymer emulsion with average particle sizes of 0.17 micron and is sold as an emulsion solution in 40 to 60% water by weight. FLEXBOND® 381 Emulsion contains a Vinyl-Acrylic Polymer with particle sizes in a range of 0.10 to 0.30 micron and is sold as an emulsion solution that is 55% solids in water. These emulsion binders described above are used as they are sold, and described herein, in the amount of between 25 to 95% and preferably between 25 to 95% of the total weight of the decorating medium. Additionally, Airflex 500 and Airflex 728 emulsions are both fine particle-size polymers developed specifically for the paint industry. Airflex 500 emulsion, a 55% solids vinyl acetate-ethylene copolymer, has a Tg of +5C and a high critical PVC (Pigment Volume Concentration), with excellent low temperature coalescence. Airflex 728 emulsion, a 52% solids vinyl acetate-vinyl chloride-ethylene terpolymer, has a Tg of 0C and a high critical PVC with excellent low temperature application properties and efflorescence resistance.

Turning to the acrylic polymer component of the instant polyvinyl resin/acrylic polymer primary emulsion binder composition, preferred are acid functional acrylic addition polymers which are polymers of ethylenically unsaturated acrylic monomers, such as acrylic or methacrylic acid and their esters. Examples of esters of acrylic or methacrylic acid are their $C_{1-8}$ alkyl esters such as methyl methacrylate, ethyl acrylate, butyl acrylate, butl methacrylate, and 2-ethyl hexyl acrylate. Other acrylic monomers include hydroxyl functional monomers such as hydroxyethyl acrylate, hydroxyethyl methacrylate and hydroxybutyl acrylate and amine functional monomers such as dimethylaminoethyl methacrylate. Most preferred in the instant primary binder emulsions are poly-acrylic acid polymers.

Other acrylic addition polymers useful in the instant composition also comprise $C_{8-30}$ hydrophobic alkyl chains. Such hydrophobic chains can be introduced by including a monomer having alkyl chains such as decyl acrylate, dodecyl acrylate, laurvl methacrylate, stearyl methacrylate or steryl itaconate. Such alkyl chains can also be indirectly attached to the polymer chain, for example via a poly(ethylene glycol) chain.

Examples of such commercially available aqueous acrylic polymer emulsions that may be advantageously used in the compositions of the present invention include those manufactured by Rohm & Haas Company and sold under the name RHOPLEX.RTM. AC-234 and AC-235. RHOPLEX.RTM. AC-234 is a medium gloss alkali swellable non-ionic aqueous acrylic copolymer having a glass transition temperature of about 6.degree. C. and a pH of from about 9.5 to about 10.0. RHOPLEX.RTM. AC-235 is similar to RHOPLEX.RTM. AC-234, but has a slightly higher glass transition temperature of about 13.degree. C. Both are stated by the manufacturer to comprise emulsions which contain about 47 wt. % acrylic resin solids, about 53 wt. % water, and an undisclosed amount of an emulsifier. Preferred herein are specially modified crosslinked poly-acrylic acid polymers sold under the trademark CARBOPOL® ETD™ by Noveon, Inc of Ohio.

The acrylic polymers included in the composition of the present invention also have the advantage of providing a flexible film that remains flexible when subjected to hostile physical handling, cleaning or laundering without requiring the inclusion of a plasticizer. When relatively "hard" acrylic polymers (those having glass transition temperatures that are relatively low) are used, plasticizers are required to provide the requisite flexibility in the resulting film. However, the plasticizers leach out of the film relatively quickly, lending to premature cracking of the film. The present composition, which advantageously does not include such plasticizers overcomes these limitations.

The coatings and adhesive compositions herein are characterized by viscosities approaching that of ordinary paint or the less viscous coating formulations. A dried coat of the instant formulations have elongation values and adhesion characteristics conforming to the quality and safety standards necessary for application to toy products. In addition, these coatings or paints have ultimate tensile values of greater than about 500 psi indicating that toughness is not being sacrificed to flexibility in the use of these coating compositions. It is important that coatings or paints used for application to toy articles, such as a soft elastomeric doll facial element or a polyvinyl chloride sheet material, have high tensile strength so that the coated or painted article have child use durability especially as to stretchability. The instant paint and coating compositions have flexibility at both ambient and cold temperatures.

Paint application equipment constrains good application of coatings with viscosities that are greater than average paint and surface coating formulations and, accordingly, the viscosity of the instant compositions for a paint or film coating application have to be controlled by keeping a proper ratio of solids to water mixture. Stringing, nozzle clogging, and inconsistent or poor coating application occurs at high viscosities. A combination of high percent elongation, high adhesion, and low modulus in the instant compositions are shown to have good correlation with excellent lay flat characteristics in a finish coated elastomeric or polyvinyl chloride article. The resultant properties of the instant coating and adhesive compositions make them ideally suited for toy paint applications especially where good lay flat character is required.

The instant coating may be applied as a paint and accordingly the composition would contain a pigment, dye, or colorant in amounts of up to 3% by weight in addition to the other components described herein as indicated. The pigment used herein is not particularly limited and various inorganic or organic pigments can be employed. Concrete examples of pigments and colorants are: synthetic organic colorants sold as the T-series by the Day Glow Corporation of South Gate City, Calif. Other pigments which can be used include sodium aluminum sulpho silicate sold as MR 582 by the Cleveland Pigment Corp. of Cleveland, Ohio; polyamide condensates with organic dyes with less than 2% phthalocyanine; and tetra-chloro-zincate sold by the Day Glow Corporation; and the pigment dispersions mentioned above, preferably those sold under the trademark, Hostafine.

In reinforcement of the additives mentioned above, compositions made in accordance with the present invention may additionally employ gelling and thickening agents such as ethylene glycol, glycerine, propylene glycol and clay mixtures to provide the desired texture and body for ease of application of the instant coating and paint compositions. In certain coating applications, fillers and stabilizers such as organic and inorganic fibers, sand, talc and mixtures thereof may also be included as part of the coating composition. Compositions of the present invention can be applied by any means such as with a brush, a cloth, or a spray applicator. The surface of a elastomeric or polyvinyl polymeric substrate surface should be clean and dry before application of the instant coating. Once applied the compositions should be allowed a sufficient period to allow curing of the composition by drying or evaporation of the aqueous solvents.

As indicated the instant coating or paint composition contains a polyvinyl film forming component of the instant binder comprised of about 10 to 30% by weight of the aqueous polyvinyl polymer of the primary binder and from 1 to 10% (preferably from 3-5%) of the total aqueous paint emulsion. It is preferably used herein in the form of water-soluble polyvinyl alcohol which is of an average molecular weight of about 93,400 and is of a grade having 85 to 95% degrees of hydrolysis. It has been determined that a low molecular weight polyvinyl alcohol tends to make a composition less viscous and amenable for coating or paint application. By contrast, a high molecular weight polymer makes the composition more thixotropic or clumpy and difficult to apply as a coating or paint. As such, a blend of molecular weights of an average of about 93,400 provides the ability to perform as a coating ingredient. In this regard, it is contemplated that the preferred embodiment of the present invention include approximately up to 18% by weight of the polyvinyl polymer with the cited average molecular weight. Preferably the polymer is in the form of polyvinyl alcohol which can be combined with up to about 60% polyvinyl pyrrolidone to form a polyvinyl-based binder which is unique in rendering the instant coating compositions advantageously applicable to elastomeric or polyvinyl surfaces. It is well to note that while an exemplary composition herein contains polyvinyl alcohol having an average molecular weight of about 93,400, higher or lower average molecular weights of polyvinyl alcohol can be employed to generate the instant distinctive coating composition.

As indicated, the film forming component of the instant coating binder contains a synthetic component comprised of a polyvinyl resin. The operable polyvinyl resin that can be used in the instant invention are emulsions of polyvinyl acetate, polyvinyl alcohol, polyvinyl pyrrolidone, or polyvinyl butyral and copolymers (including terpolymers) and mixtures thereof. Poly(vinyl alcohol) resin, is to be used as a preferred film former additive in the present composition and is a cream-colored powder which is soluble in water and insoluble in most organic solvents. It is made by the hydrolysis of poly(vinyl acetate) and, when commercially purchased, may be partially or fully hydrolyzed. Partially hydrolyzed (88 percent), medium weight (85,000-146,000) polyvinyl alcohols have proved useful as additives to inks, paints and colorants in toy products. Among the useful PVA polymeric resins useful as film formers in the present invention are those sold under the tradenames AIRVOL 523, AIRVOL 205 and AIRVOL WS42 by Air Products & Chemicals, Inc. and ELVANOL 52-22 by E.I. du Pont de Nemours and Company and CELVOL 23S and CELVOL 205 by ISP Technologies, Inc. A particularly effective film forming latex component of the instant composition comprises a combination of PVA with up to 60% PVP.

As an example of an industrial methodology that is typically utilized in the preparation of the compositions of the present invention, the preparation of a water-based vinyl acetate resin/acrylic polymer/polyvinyl resin emulsion paint is provided in the following paragraph.

First, 23.0 lbs. of deionized water were added to a clean 50 gallon paint kettle. Dispersion (mixing) was begun at a slow speed. With the disperser running, the following were added: 2.3 lbs. defoamer (Dow Corning FG-10), 100 lbs. 100 lbs of vinyl acetate-ethylene copolymer (AIRFLEX 406), 140.0 lbs. acrylic resin (RHOPLEX.RTM. AC-234), 2.3 lbs. surfactant (STEPAN-MILD BSB), 1.4 lbs. TITANIUM DIOXIDE whitening pigment, 2.1 lbs. preservatives (1.4 lbs. KATHON CG/ICP), and 11.0 lbs. pH regulant (2-amino 2-methyl 1-propanol (AMP)) and 0.5 lbs of guar gum as a thickener. The mixing speed was then adjusted to 500 rpm for five minutes. 22.5 lbs. of a 60/40 mixture of PVP/PVA powder mixture was then premixed was then added to water in a five gallon bucket until the powder is dispersed. The mixture was then added to the paint kettle while the kettle was stirred. The kettle was stirred at 500 rpm for five minutes. The mixing speed was increased to 1500 rpm and mixing continued for three minutes. The mixing speed was reduced to 500 rpm and mixing continued for fifteen minutes. After the dispersion was complete, 45.0 lbs. of a pigment dispersion comprised of a mixture of Hostafine Yellow GR was added. A paddle was used to pull the pigment dispersion in from the sides of the kettle. Mixing was continued at 500 rpm for fifteen minutes.

By modifying the foregoing method of preparation, other paint formulations within the scope of this invention may be prepared. For example, for preparing a glossy, pigmented, non-glitter composition, a glitter component in the form of POLY*FLAKE is added to the 50 gallon paint kettle along with the pigment dispersion. An Example of the composition of such a glossy paint, as well as other paints within the scope of the present invention, are provided below.

Having generally described the present invention, the following examples are set for the below to further demonstrate compositions embodying the present invention. The compositions of the present invention are prepared by adding specified amounts of the polyvinyl acetate/acrylic polymer emulsions to the film forming polyvinyl resin in an aqueous medium under agitaiton. Specified amounts of other ingredients are added where indicated. In the following Example 1, the applied paint composition is subjected to an Eraser Abrasion Test, a Surface Coating Adhesion (Tape Pull) Test, and Stretch Tests to determine the adhesion and stretch characteristics of the present coating and paint composition. These tests are carried out employing standard Quality and Safety Operating Procedures of the Assignee of the present application, Mattel, Inc.

EXAMPLE 1

A 50-70% percent solids content vinyl acetate/ethylene copolymer aqueous emulsion commercially available as AIRFLEX 500,available from Air Products, Inc of Allentown, Pa., is added to a mixer containing a water solution of an acrylic polymer emulsion manufactured by Noveon, Inc. and sold under the name CARBOPOL EDT. During mixing, a film forming resin powder comprised of mixture of polyvinyl pyrrolidone/polyvinyl alcohol in a 60(PVP)/40(PVA) ratio (sold under the name CELVO 205 by Celanese Corp.) is added to the mixed vinyl acetate/ethylene emulsion. After mixing and adding additional distilled water and other release agents, fillers, and titanium dioxide whitener to homogenize the resulting latex emulsion, the viscosity of the solution is slightly greater than water. 1% by weight of a red pigment in the form of a pigment dispersion sold under the name HOSTAFINE (provided by Clariant Corporation) was added to the paint coating solution with stirring continued until dispersion of the pigment and generation of a red color to the coating (paint) composition.

A molded soft elastomeric doll face comprised of a solid molded SEBS elastomeric copolymer was provided and the paint composition applied to the cheek and lip areas of the molded doll face. The rubbery painted doll facial item was allowed to dry for 3 minutes. Thereafter the soft painted rubbery painted doll face was subjected to 1600% Elongation Test and an Eraser Abrasion Test. The tests revealed that the paint coating did not split, peel, or abrade under the tests. The surface bonding between the applied coating and the surface substrate was so strong and uniform so as cause complete adhesion between the styrenic coating and the rubbery elastomeric substrate surface.

The compositional content of this Example 1 is as follows:

Red Paint

| Component | wt. % |
|---|---|
| Deionized Water (dye vehicle) | 39.42 |
| Kathon PFM (preservative) | 0.08 |
| Nuosept 95 (preservative) | 0.30 |
| AMP 95 (pH regulant) | 0.50 |
| FC120 (surfactant) | 0.05 |
| Rhodapex EST30 (surfactant) | 0.25 |
| Potassium Chloride (neutral buoyancy additive) | 4.00 |
| Celvo 205 (polyvinyl alcohol/PVP particles) | 10.00 |
| Airflex 500 (primary polyvinyl acetate-ethylene copolymer) | 20.00 |
| Carbopol ETD (acrylic polymer emulsion) | 20.00 |
| Hostafine Yellow GR (colorant) | 2.15 |
| Hostafine Rubine F6B (colorant) | 3.25 |

The coating and paint compositions of the present invention possess unique combinations of properties, including both a high degree of elastic durability under suddenly applied stresses, and a high degree of plasticity when the stress is applied more slowly. The miscible character of the polyvinyl based aqueous coating composition when applied to an elastomeric or polyvinyl chloride polymer substrate surface causes an anneal like bonding with that substrate surface so as to form a physically indistinguishable layer with that surface. Accordingly the well bonded compositional layer reacts to the physical stresses applied to the body of the substrate in exactly the same manner as the underlying substrate. Therefore the coating will stretch, strain, and impact as its substrate underlayer and shoe no splitting or peeling. Other properties include excellent stability throughout a very wide temperature range as well as an odor free character to the coating due to the coating aqueous nature. Most importantly, the applied coatings of these novel compositions are nontoxic and, therefore, coated toy items are safe for use by children of all ages.

Having thus described the principals of the invention, together with illustrative embodiments thereof, it is to be understood that although specific terms are employed, they are used in a generic and descriptive sense and not for the purpose of limitation, the scope of the invention being set forth in the following claims.

What is claimed:

1. An aqueous coating composition for thermoplastic resin substrate surfaces comprising (i) a colorant, (ii) a polyvinyl acetate polymer/acrylic polymer emulsion blend primary binder, (ii) a polyvinyl-based film forming resin secondary binder comprised of polyvinyl alcohol and another resin selected from the group consisting of polyvinyl acetate, polyvinyl pyrrolidone, polyvinyl butyral and copolymers and mixtures therof, the polyvinyl alcohol being in a fine powder form having a particle size of from about 1 micron to 140 microns in particle diameter and in an amount of from 10 to 80 wt % of the total solids content of the coating composition, and water with sufficient amount of a surface active agent to form a stable suspension.

2. The coating composition of claim 1 wherein the polyvinyl acetate polymer of the primary binder is polyvinyl acetate homopolymer or copolymer comprised of polyvinyl acetate and ethylene, vinyl esters or acrylates.

3. The coating composition of claim 1 wherein the vinyl acetate resin in the primary binder is a vinyl acetate-ethylene copolymer and the acrylic polymer is an acrylic or methacrylic acid and their esters.

4. The coating composition of claim 3 wherein the primary binder emulsion contains up to 49% by weight of the vinyl acetate-ethylene copolymer and the acrylic polymer is crosslinked poly-acrylic acid.

5. The coating composition of claim 4 wherein the polyvinyl acetate polymer/acrylic polymer emulsion blend primary binder is at a concentration of from about 25 to 60 weight percent of solids in the coating composition.

6. The coating composition of claim 1 wherein the colorant is a pigment dispersion is present in an amount of from 0.1 to about 10% by weight of the coating composition.

* * * * *